US009223279B2

(12) United States Patent
Goto

(10) Patent No.: US 9,223,279 B2
(45) Date of Patent: Dec. 29, 2015

(54) IMAGE FORMING APPARATUS, IMAGE FORMING METHOD AND NON-TRANSITORY COMPUTER-READABLE STORAGE MEDIUM

(71) Applicant: BROTHER KOGYO KABUSHIKI KAISHA, Nagoya-shi, Aichi-ken (JP)

(72) Inventor: Yuji Goto, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/668,662

(22) Filed: Mar. 25, 2015

(65) Prior Publication Data

US 2015/0277307 A1 Oct. 1, 2015

(30) Foreign Application Priority Data

Mar. 31, 2014 (JP) ..... 2014-070813

(51) Int. Cl.
*G03G 15/00* (2006.01)
*G03G 15/20* (2006.01)

(52) U.S. Cl.
CPC ..... *G03G 15/5095* (2013.01); *G03G 15/5062* (2013.01); *G03G 15/2039* (2013.01)

(58) Field of Classification Search
CPC ..... G03G 15/2039; G03G 15/5062; G03G 15/5095
USPC ..... 399/45, 49, 196, 198, 200
See application file for complete search history.

(56) References Cited

U.S. PATENT DOCUMENTS 7,583,282 B2 * 9/2009 Yamauchi ..... G03G 15/5062

FOREIGN PATENT DOCUMENTS

JP H092789 A 1/1997
JP 2001066948 A 3/2001

* cited by examiner

*Primary Examiner* — Susan Lee
(74) *Attorney, Agent, or Firm* — Merchant & Gould PC

(57) ABSTRACT

An image forming apparatus includes an image forming device forming an image, a fixing device for heat-fixing the image on a sheet, a belt for conveying the sheet toward the fixing device, a sensor, and a control device configured to control the image forming device to form marks bridging over the belt and the sheet having passed through the fixing device at both ends of the sheet, obtain a length between remaining marks left on the belt after the sheet having the marks formed thereon is conveyed to a downstream side of the belt, on the basis of an output signal of a sensor which output is changed depending on whether there are the marks, and adjust a printing magnification of an image to be formed on the sheet on the basis of the length between the remaining marks.

20 Claims, 9 Drawing Sheets

IMAGE FORMING APPARATUS, IMAGE FORMING METHOD AND NON-TRANSITORY COMPUTER-READABLE STORAGE MEDIUM

CROSS-REFERENCE TO RELATED APPLICATIONS

This application claims priority from Japanese Patent Application No. 2014-070813 filed on Mar. 31, 2014, the entire subject-matter of which is incorporated herein by reference.

TECHNICAL FIELD

The disclosure relates to an image forming apparatus, an image forming method and a storage medium. More specifically, the present disclosure relates to a technology of adjusting a printing magnification, in correspondence to shrinkage of a sheet.

BACKGROUND

According to an image forming apparatus that forms an image electrophotographically, the image is formed on a sheet and the image is then heat-fixed on the sheet by a fixing device. It has been known that the sheet is shrunken upon the heat fixing.

There has been disclosed a technology of coping with the shrinkage of the sheet. For example, there has been disclosed a technology of adjusting a positional deviation between a surface and a backside upon a duplex printing. In this technology, an image forming apparatus is configured to first form a mark for adjustment on one surface of a sheet. Then, the mark is measured by a sensor before the sheet passes through a fixing device. After that, the sheet having the mark formed thereon is enabled to pass through the fixing device, the sheet is conveyed to a measurement position of the same sensor without reversing the surface and backside of the sheet, and the mark is measured by the sensor. Then, a sheet shrinkage ratio is specified from the first measurement result and the second time measurement result.

SUMMARY

Illustrative aspects of the disclosure provide an image forming apparatus having less limitation as regards an apparatus configuration and capable of adjusting a printing magnification, in correspondence to shrinkage of a sheet.

One illustrative aspect of the disclosure provides an image forming apparatus comprising: an image forming device configured to form an image; a fixing device configured to heat-fix the image on a sheet; a belt configured to convey the sheet toward the fixing device; a sensor; and a control device configured to: control the image forming device to form marks bridging over the belt and the sheet having passed through the fixing device at a first end of the sheet and at a second end of the sheet that is opposite to the first end; and adjust a printing magnification of an image to be formed on the sheet, comprising:

obtaining a length between remaining marks left on the belt after the sheet having the marks formed thereon is conveyed to a downstream side of the belt, on the basis of an output signal of the sensor of which an output is changed depending on whether there are the marks formed on the sheet; and adjusting the printing magnification of the image to be formed on the sheet on the basis of the length between the remaining marks.

DETAILED DESCRIPTION

General Overview

Figure 1:
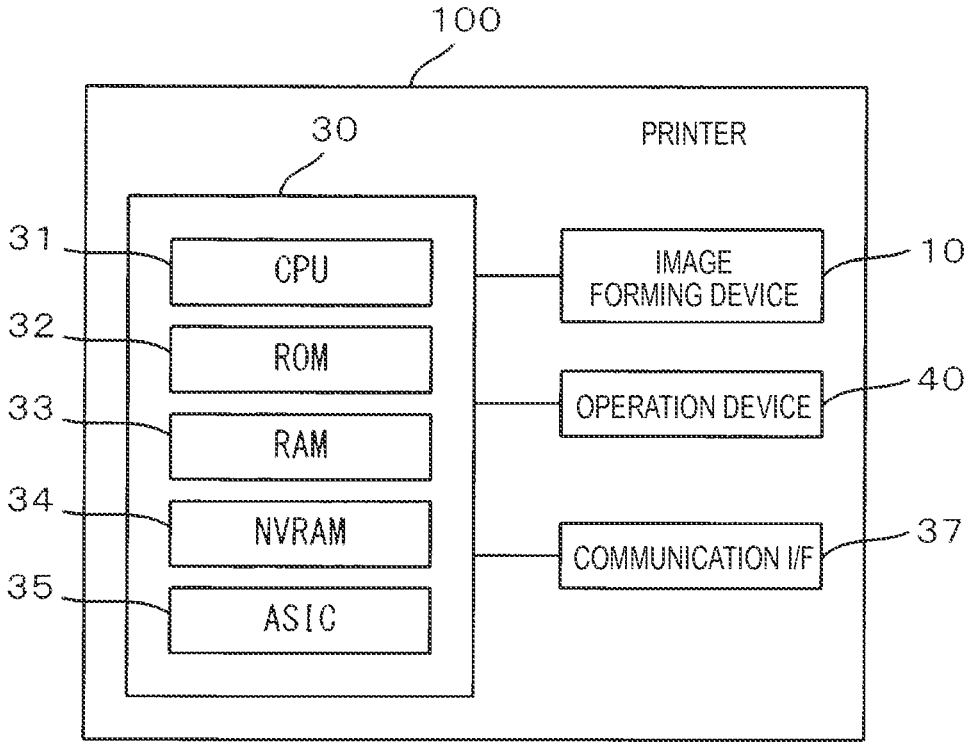
FIG. 1 is a block diagram showing an electrical configuration of a printer according to an illustrative embodiment.

The above-described related-art technology may have some disadvantages. For example, since the mark formed on one surface of the sheet is measured two times by the same sensor, it is necessary to arrange the sheet at a position at which the mark formed on the sheet can be read. Also, a mechanism configured to again convey the sheet having the mark formed thereon to the measurement position of the sensor without reversing the surface and backside of the sheet is required. That is, there are many limitations as regards the apparatus configuration, so that a degree of freedom of the apparatus design is low.

Therefore, illustrative aspects of the disclosure provide an image forming apparatus having less limitation as regards an apparatus configuration and capable of adjusting a printing magnification, in correspondence to shrinkage of a sheet.

According to one illustrative aspect of the disclosure, there may be provided an image forming apparatus comprising: an image forming device configured to form an image; a fixing device configured to heat-fix the image on a sheet; a belt configured to convey the sheet toward the fixing device; a sensor; and a control device configured to: control the image forming device to form marks bridging over the belt and the sheet having passed through the fixing device at a first end of the sheet and at a second end of the sheet that is opposite to the first end; and adjust a printing magnification of an image to be formed on the sheet, comprising: obtaining a length between remaining marks left on the belt after the sheet having the marks formed thereon is conveyed to a downstream side of the belt, on the basis of an output signal of the sensor of which an output is changed depending on whether there are the marks formed on the sheet; and adjusting the printing magnification of the image to be formed on the sheet on the basis of the length between the remaining marks.

The image forming apparatus according to the disclosure is configured to from the marks bridging over the sheet and the belt at the one and other ends of the sheet having passed through the fixing device, respectively. The image forming apparatus is configured to obtain the length between the remaining marks left on the belt after the sheet is conveyed, based on the output signal of the sensor. Since it is possible to suppose a length of the sheet after the fixing by the length between the remaining marks, the image forming apparatus is configured to adjust the printing magnification on the basis of the length between the remaining marks, in correspondence to shrinkage of the sheet. The sheet on which the marks are formed may be a sheet, which has passed through the fixing device and has been automatically re-conveyed by the image forming apparatus, or a sheet that has passed through the fixing device, has been discharged and has been again set on a sheet feeding tray by a user.

That is, the image forming apparatus according to the disclosure is configured to form the marks bridging over the sheet and the belt on the sheet having passed through the fixing device and then to read the remaining marks left on the belt by the sensor. For this reason, the sensor may be arranged at any position at which the sensor can read the marks on the belt, and is not limited to a position at which the sensor can read the marks on the sheet being conveyed by the belt. Also, since it is not necessary to read the parts of the marks to be left on the sheet, the marks may be formed on any surface of the sheet. For this reason, a sheet conveying mechanism for enabling the same surface to be printed upon the first printing and upon the second time printing is not required. Therefore, the image forming apparatus has less limitation as regards the apparatus configuration and a high degree of freedom of the apparatus design is high.

In the adjusting the printing magnification, the control device may be configured to individually adjust the printing magnification on a first surface of the sheet, which is first printed upon a duplex printing, and on a second surface of the sheet, which is later printed.

The sheet shrinkage ratio is different between the first and second surfaces of the sheet. For this reason, it is preferably to individually adjust the printing magnification on the first surface and the second surface.

In the adjusting the printing magnification, the control device may be configured to: obtain a deviation value from a reference position of the remaining marks on the basis of the output signal of the sensor; and adjust the printing magnification on the basis of the deviation value and the length between the remaining marks.

By obtaining the deviation value from the reference position, it is possible to adjust a deviation value caused by a main body that is another factor causing the deviation other than the sheet shrinkage.

In the adjusting the printing magnification, the control device may be configured to adjust, based on the length between the remaining marks in a first direction, the printing magnification in a second direction.

The directions include a main scanning direction and a sub-scanning direction, for example. It is possible to suppose the sheet size from the length between the remaining marks in the one direction. For this reason, it is possible to adjust the printing magnification without forming the marks in the other direction.

The control device may be configured to control the image forming device to form the marks in a case of printing internal data on the sheet.

The internal data includes mark data for manual adjustment, test print data, print hysteresis data and apparatus status data, for example. A printed material of the internal data is not preserved for a long time or provided to a third party, and is discarded early after it is checked and a degree of importance thereof is relatively low. For this reason, when the marks are formed using the printing of the internal data, it is possible to reduce the waste of the sheet.

In the adjusting the printing magnification, the control device may be configured to change a printing magnification, which is to be obtained on the basis of a next output signal of the sensor, on the basis of a printing magnification obtained when a mark for manual adjustment is printed on the sheet and a printing magnification obtained on the basis of the output signal of the sensor.

The printing magnification is changed on the basis of the printing magnification obtained from the mark for manual adjustment, so that it is possible to expect the improvement on the precision of the printing magnification.

The control device may be configured to control the image forming unit to form the marks in response to detecting at least one of a change in the number of sheets except for a printing, an increase in a sheet feeding tray, a replacement of the sheet and an opening or closing operation of the sheet feeding tray.

When at least one thereof is detected, there is a high possibility that a type of the sheet will be changed. For this reason, it is preferably to again adjust the printing magnification at corresponding timing.

A plurality of the image forming devices may be provided, and in the controlling the image forming device to form the marks, the control device may be configured to form the marks by using the same image forming device.

By using the same image forming device, it is possible to avoid an influence of the deviation between the image forming devices on the printing magnification.

In the controlling the image forming device to form the marks, the control device may be configured to control the image forming device to form the marks even though the sheet, which is a formation target of the marks, does not pass through the fixing device, and in the adjusting the printing magnification, the control device may be configured to adjust the printing magnification of the image, based on a length between remaining marks of the marks formed at a state where the sheet does not pass through the fixing device, and the length between the remaining marks of the marks formed after the sheet passed through the fixing device.

The marks are formed tow times and the respective marks are read with the same sensor, so that it is possible to expect that the printing magnification will be adjusted more precisely.

The control device may be configured to obtain a length of the sheet, and in the adjusting the printing magnification, the control device may be configured to adjust the printing magnification of the image based on the length of the sheet obtained in the obtaining the length of the sheet and the length between the remaining marks obtained by the output signal of the sensor.

A length of the sheet may be obtained by a user's input or may be measured using a sensor positioned upstream from the image forming device, for example. Since it is possible to adjust the printing magnification by forming the marks one time, it is possible to reduce the consumption of the toner.

The image forming apparatus may further comprise: a re-conveyance mechanism configured to convey the sheet having passed through the fixing device toward an upstream side of the belt, wherein the sheet on which the marks may be formed in the formation processing is a sheet having passed through the fixing device having been returned to the belt by the re-conveyance mechanism and having been conveyed by the belt.

The marks are rapidly formed after the fixing by the sheet re-conveyance mechanism, so that a user's labor is reduced and it is possible to expect that the printing magnification will be adjusted more precisely.

A control method and a computer program for implementing the functions of the image forming apparatus, and a non-transitory computer-readable medium having the computer program stored thereon are also novel and useful.

According to the present disclosure, it is possible to implement the image forming apparatus having less limitation as regards an apparatus configuration and capable of adjusting the printing magnification, in correspondence to shrinkage of the sheet.

Illustrative Embodiments

Hereinafter, an illustrative embodiment of the image forming apparatus of the present disclosure will be described in detail with reference to the accompanying drawings. In this illustrative embodiment, the present disclosure is applied to a printer configured to form an image by an electrophotographic method.

As shown in FIG. 1, a printer 100 of this illustrative embodiment has a controller 30 having a CPU 31, a ROM 32, a RAM 33, an NVRAM (Non-Volatile RAM) 34 and an ASIC 35. Also, the printer 100 has an image forming device 10 configured to form an image by an electrophotographic method, an operation device 40 configured to receive an input operation from a user and a communication interface 37 for connection to an external device, which are controlled by the CPU 31. Incidentally, the controller 30 shown in FIG. 1 is a generic term of a configuration having integrated the hardware used for control of the printer 100 such as the CPU 31 and does not actually indicate only the single hardware existing on the printer 100.

In the ROM 32, firmware, which is a control program for controlling the printer 100, various settings and initial values and the like are stored. The RAM 33 is used as a work area from which a variety of control programs are read or a storage area configured to temporarily store therein image data.

The CPU 31 is configured to store a processing result in the RAM 33 or NVRAM 34, in response to signals transmitted from a variety of sensors and the control program read out from the ROM 32, and to control the respective constitutional elements of the printer 100. The CPU 31 is an example of the control device. Incidentally, the controller 30 may be the control device or the ASIC 35 may be the control device.

The communication interface 37 is hardware configured to perform communication with other apparatus. As the specific communication interface, a wired LAN interface, a wireless LAN interface, a serial communication interface, a parallel communication interface and a facsimile interface may be exemplified. The printer 100 may receive a job for enabling the image forming device 10 to form an image from an external device through the communication interface 37.

The operation device 40 is provided on an external side of the printer 100 and has a variety of buttons configured to receive an input operation from a user and a touch panel configured to display a message and setting contents. The various buttons include an execution button for controlling the image forming device 10 to form an image and a cancel button for inputting an instruction to cancel the image formation, for example. Also, the user touches a finger on the touch panel, so that the operation device 40 receives a variety of inputs.

Figure 2:
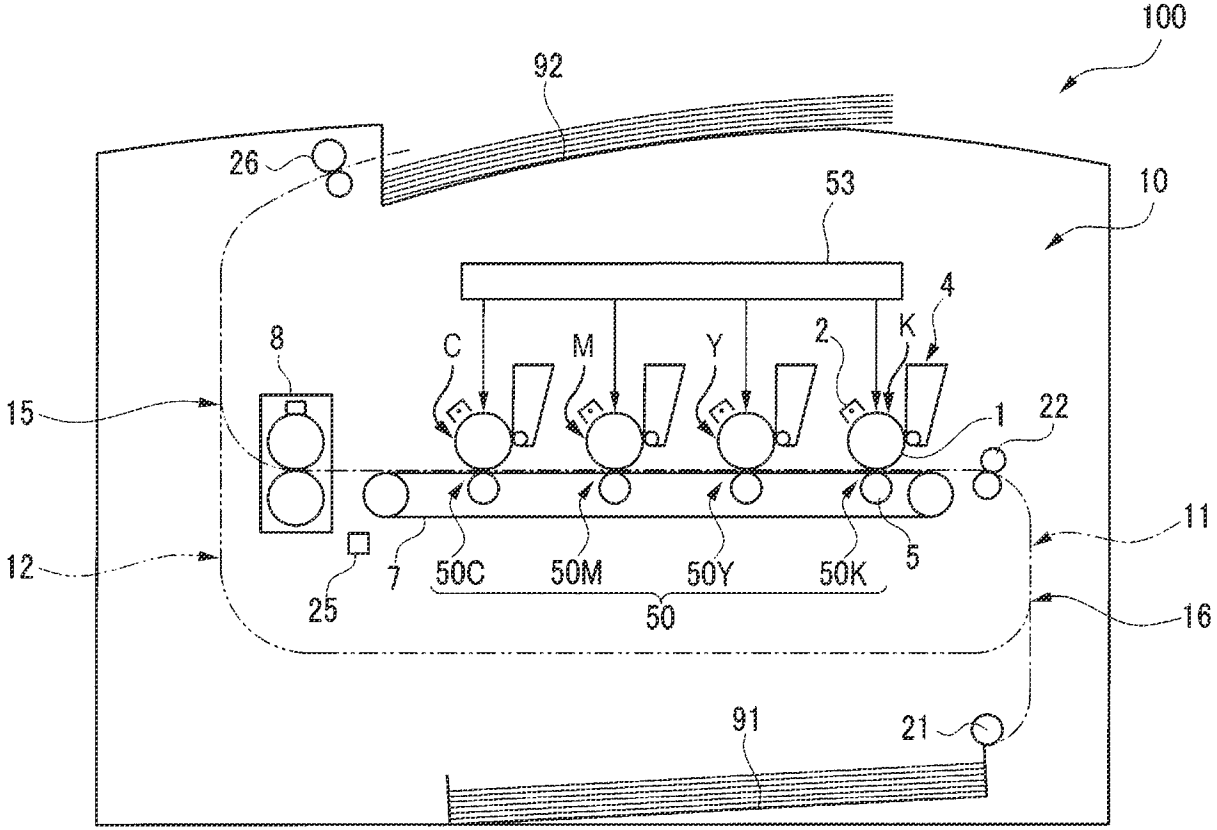
FIG. 2 is a sectional view illustrating an internal configuration of the printer shown in FIG. 1.

Subsequently, a configuration of the image forming device 10 of the printer 100 is described with reference to FIG. 2. The image forming device 10 has a process device 50 configured to form a toner image by an electrophotographic method and to transfer the toner image to a sheet, an exposure device 53 configured to illuminate light to the process device 50, a fixing device 8 configured to fix toner on the sheet, which has not been fixed, a sheet feeding tray 91 configured to place therein the sheet before the image transfer, a sheet discharge tray 92 configured to place thereon the sheet after the image transfer, and a conveyance belt 7 configured to convey the sheet to a transfer position of the process device 50. The conveyance belt 7 is an example of the belt. The fixing device 8 is an example of the fixing device.

Also, the printer 100 is provided therein with a substantially S-shaped conveyance path (which will also be referred to as 'printing path') 11 (dashed-dotted line in FIG. 2) so as to guide the sheet accommodated in the sheet feeding tray 91 positioned at a bottom to the upper sheet discharge tray 92 by sheet discharge rollers 26 via a feeder roller 21, registration rollers 22, the process device 50 and the fixing device 8.

The process device 50 can form a color image, and process devices corresponding to respective colors of cyan (C), magenta (M), yellow (Y) and black (K) are arranged in parallel. Specifically, the process device 50 has a process device 50C configured to form a cyan (C) image, a process device 50M configured to form a magenta (M) image, a process device 50Y configured to form a yellow (Y) image and a process device 50K configured to form a black (K) image. The process devices 50C, 50M, 50Y, 50K are arranged at an equal interval in corresponding order from a downstream side with respect to a conveying direction of the sheet. Incidentally, the order of the process devices is not limited thereto.

The process device 50K has a drum-shaped photosensitive member 1, a charging device 2 configured to uniformly charge a surface of the photosensitive member 1, a developing device 4 configured to develop an electrostatic latent image on the photosensitive member 1 by toner, and a transfer device 5 configured to transfer a toner image on the photosensitive member 1 to the sheet or conveyance belt 7. The photosensitive member 1 and the transfer device 5 are configured to face each other with the conveyance belt 7 being interposed therebetween. The other process devices 50C, 50M, 50Y also have the same configurations as the process device 50K.

In each of the process devices 50C, 50M, 50Y, 50K, the surface of the photosensitive member 1 is uniformly charged by the charging device 2. Then, the surface of the photosensitive member 1 is exposed by the light emitted from the exposure device 53, so that an electrostatic latent image of an image to be formed is formed on the photosensitive member 1. Then, the toner is supplied to the photosensitive member 1 through the developing device 4. Thereby, the electrostatic latent image on the photosensitive member 1 becomes visible as a toner image.

The image forming device 10 is configured to pick out the sheet placed in the sheet feeding tray 91 one at a time and to convey the sheet onto the conveyance belt 7. Then, the image forming device 10 is configured to transfer the toner image formed in the process device 50 to the sheet. At this time, upon a color printing, the toner images are formed in the respective process devices 50C, 50M, 50Y, 50K and the respective toner images are made to overlap with each other on the sheet. On the other hand, upon a monochrome printing, the toner image is formed only in the process device 50K and is then transferred to the sheet. After that, the image forming device 10 is configured to convey the sheet having the toner image transferred thereto to the fixing device 8 and to heat-fix the toner image on the sheet. Then, the image forming device 10 is configured to discharge the sheet after the fixing to the sheet discharge tray 92.

Also, the printer 100 is provided therein with a conveyance mechanism for performing a duplex printing. A re-conveyance path 12 (dashed-two dotted line in FIG. 2) in FIG. 2 is a conveyance path for re-conveying the sheet having passed through the fixing device 8 to the process device 50 so as to perform a printing for a second surface (the backside) of the sheet of which a first surface, which is one surface, has been printed. The re-conveyance path 12 is an example of the re-conveyance mechanism.

The re-conveyance path 12 diverges from a printing path 11 at a branch point 15, which is positioned downstream from the fixing device 8 and upstream from the sheet discharge rollers 26 with respect to the conveying direction of the sheet. The re-conveyance path 12 passes between the process device 50 and the sheet feeding tray 91 from the branch point 15 and joins with the printing path 11 at a confluence point 16 of the printing path 11 positioned upstream from the registration rollers 22.

Specifically, when performing a duplex printing by the printer 100, the sheet is reversed in following order. First, the sheet of which the first surface has been formed with an image via the printing path 11 is conveyed to the sheet discharge rollers 26. After a rear end of the sheet passes through the branch point 15, the sheet is once stopped with being interposed between the sheet discharge rollers 26. Thereafter, the rotating directions of the sheet discharge rollers 26 are changed to reverse the conveying direction of the sheet, so that the sheet is introduced to the re-conveyance path 12 via the branch point 15. Then, the sheet is returned to the printing path 11 via the confluence point 16 at an upstream side of the process device 50 with respect to the printing path 11. Thereby, the surface and backside of the sheet are reversed, so that an image is formed on the second surface.

Also, the printer 100 is configured to perform a variety of processing such as a positional deviation correction of an image, a density correction, a printing magnification correction and the like, as pre-processing for forming an image. As a sequence of the pre-processing, any one of the process devices 50C, 50M, 50Y, 50K is controlled to form marks for each pre-processing, the marks are transferred to the conveyance belt 7 and a correction value or an adjustment value is determined on the basis of detection results of the marks.

Figure 3:
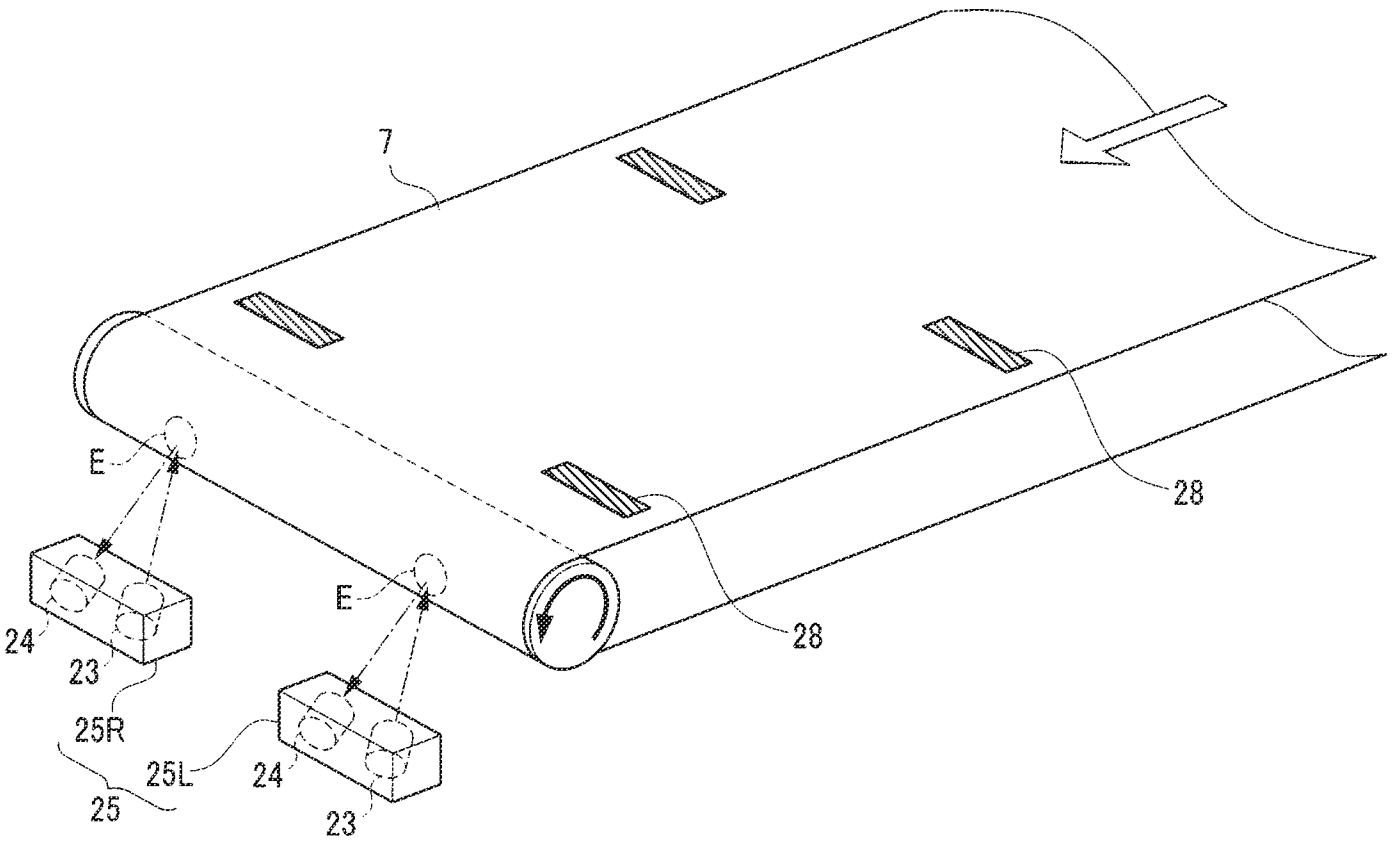
FIG. 3 illustrates an arrangement of mark sensors.

Thus, the printer 100 is configured to arrange a mark sensor 25 for detecting marks for pre-processing formed on the conveyance belt 7. Specifically, as shown in FIG. 3, the mark sensor 25 has two sensors of a sensor 25R, which is arranged at the right of the conveyance belt 7 in a width direction, and a sensor 25L, which is arranged at the left.

Each of the sensors 25R, 25L is a reflective optical sensor having a pair of a light emitting device 23 such as an LED and a light receiving device 24 such as a phototransistor. The mark sensor 25 is configured so that the light emitting device 23 emits obliquely light toward a dotted border E (FIG. 3) of the surface of the conveyance belt 7 and the light receiving device 24 receives the light. The mark 28 for pre-processing can be detected on the basis of a difference between a light receiving amount, which is received when the mark 28 for pre-processing passes, and a light receiving amount, which is directly received from the conveyance belt 7. The mark sensor 25 is an example of the sensor.

Subsequently, the various pre-processing that is executed by the printer 100 is described. The printer 100 of this illustrative embodiment is configured to execute a positional deviation correction, a developing bias correction, a gamma correction and a printing magnification adjustment, which are the pre-processing. Incidentally, the pre-processing is just exemplary and the present disclosure is not limited thereto.

The positional deviation correction is processing of obtaining correction values for adjusting a dynamic deviation of an image position, which is caused due to eccentricity of the photosensitive member 1 and the conveying rollers, a disorder of pitches of gears configured to drive the photosensitive member and the conveying rollers and the like, and a static deviation of an image position, which is caused due to deviations of mounting positions of the photosensitive member 1 and the exposure device 53 and the like. In the positional deviation correction, the printer 100 is configured to align marks of respective colors, which are elongated in a man scanning direction, in a sub-scanning direction, depending on each color. The printer 100 is configured to read the marks with the mark sensor 25, to calculate an interval between the marks and to obtain a periodic positional deviation value and a positional deviation value between the colors.

The developing bias correction is processing of obtaining a correction value for adjusting a deviation between an ideal density defined by the printer 100 and a density of an actually formed mark. In the developing bias correction, the printer 100 is configured to form a mark having a predetermined density (for example, 100%) for each color. The printer 100 is configured to read the marks with the mark sensor 25, to calculate actual densities on the basis of the light receiving amounts, and to obtain a correction value of a developing bias for approximation to an ideal density.

The gamma correction is processing of correcting a deviation between an instructed density (instructed gradation) by an external computer and an output density of the printer 100. In the gamma correction, the printer 100 is configured to form a plurality of marks of which densities are different at a predetermined density interval (for example, 20%, 40%, 60%, 80%, 100%) for each color. The printer 100 is configured to read the marks with the mark sensor 25, to calculate actual densities on the basis of the light receiving amounts and to specify a change characteristic of the density of each color from a relative relation of densities between the marks. Then, the printer 100 is configured to prepare a relative relation table between the change characteristic and the instructed gradation of the external computer.

The printing magnification adjustment is processing of forming an enlarged image in advance, depending on expected shrinkage of a sheet. In the printing magnification adjustment, the printer 100 is configured to obtain a sheet shrinkage ratio and a positional deviation ratio occurring individually in the apparatus main body and to adjust a printing magnification of an image on the basis of at least one, as required.

As the main causes of the sheet shrinkage, there is a change in a moisture absorption amount of the sheet accompanied by the heat fixing. That is, when the sheet passes through the fixing device 8, the moisture of the sheet is taken away due to the heat applied upon the fixing, so that the sheet is shrunken. For this reason, in order to correct the image after the fixing into an image that a user expects, the printer 100 is required to transfer an image, which is enlarged in consideration of a sheet shrinkage ratio, to the sheet.

Figures 1A, 4:
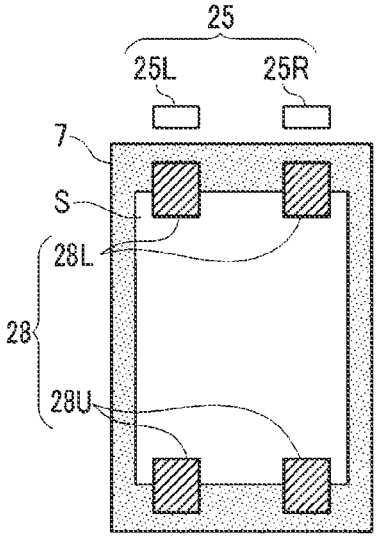
FIGS. 4-1A, 4-1B, 4-2A and 4-2B illustrate an outline of a sequence of obtaining an adjustment value for sheet shrinkage adjustment.

Therefore, the printer 100 is configured to form dedicated marks, to read the marks with the mark sensor 25 and to calculate a sheet shrinkage ratio. Specifically, the printer 100 is configured to convey one sheet S and to form marks 28 bridging over the sheet S and the conveyance belt 7 at upstream and downstream end portions of the sheet S with respect to the conveying direction of the sheet, as shown in FIG. 4-1A. The marks of the marks 28 positioned at the upstream side are referred to as marks 28U, and the marks of the marks 28 positioned at the downstream side are referred to as marks 28L. Regarding each of the marks 28U, 28L, two marks are formed at positions corresponding to the respective mark sensors 25R, 25L.

Figures 1B, 4:
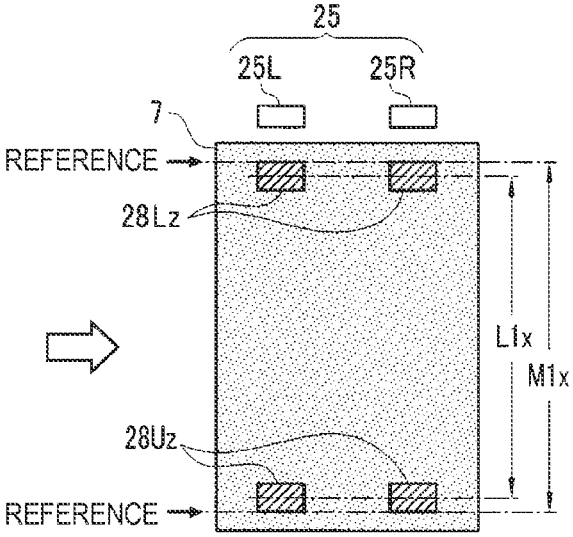

When the sheet having the marks 28 formed thereon is conveyed toward the fixing device 8 and the sheet S is separated from the conveyance belt 7, parts of the marks 28 formed on the conveyance belt 7 are left on the conveyance belt 7, as shown in FIG. 4-1B. The remaining marks, which are the left marks, are detected by the mark sensor 25. In this illustrative embodiment, the remaining mark of the mark 28U is denoted with a reference numeral 28Uz, and the remaining mark of the mark 28L is denoted with a reference numeral 28Lz. Also, the printer 100 is configured to calculate central positions of the respective remaining marks 28Uz, 28Lz in the conveying direction of the sheet on the basis of the detection results of the mark sensor 25 and to obtain an interval L1$x$ of the remaining marks 28Uz, 28Lz, which is a distance between the central positions.

Figures 2A, 4:
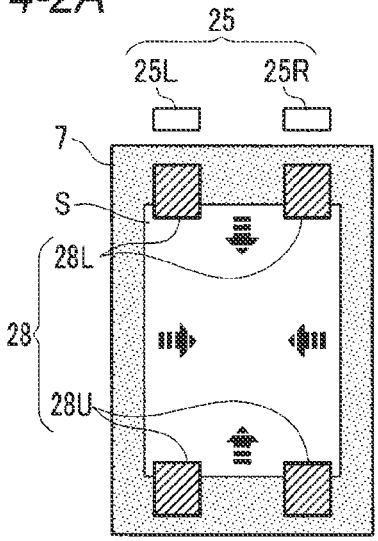

Then, the printer 100 is configured to convey the sheet S having passed through the fixing device 8 onto the conveyance belt 7 via the re-conveyance path 12. Like the first surface, the printer 100 is configured to form marks 28 bridging over the sheet S and the conveyance belt 7 at upstream and downstream end portions of the sheet S with respect to the conveying direction of the sheet, as shown in FIG. 4-2A.

Figures 2B, 4:
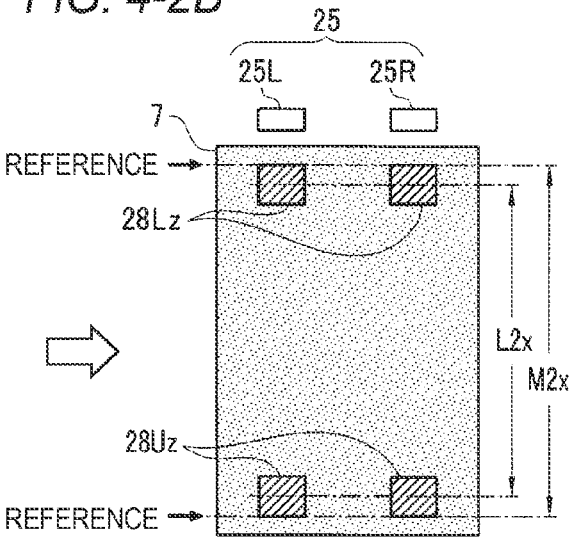

Also, like the first surface, when the sheet having the marks 28 formed thereon is conveyed toward the fixing device 8 and the sheet S is separated from the conveyance belt 7, parts of the marks 28 formed on the conveyance belt 7 are left on the conveyance belt 7, as shown in FIG. 4-2B. Then, the remaining marks 28Uz, 28Lz are detected by the mark sensor 25.

At this time, since the sheet S passed through the fixing device 8, the sheet S is shrunken. For this reason, the lengths of the remaining marks 28Uz, 28Lz in the conveying direction of the sheet are lengthened, as compared to the first surface. Since the same marks 28 are formed on the first surface and the second surface, a reference start position at which the formation of the marks 28 starts and a reference end position at which the formation is over are the same on the first surface and the second surface. For this reason, when the sheet S is shrunken, the lengths of the remaining marks 28Uz, 28Lz in the conveying direction of the sheet are lengthened as long as the shrunken length. As a result, when the central positions of the respective remaining marks 28Uz, 28Lz in the conveying direction of the sheet are calculated, an interval L2$x$ of the remaining marks 28Uz, 28Lz is shortened. A sheet shrinkage ratio is calculated by comparing the intervals L1$x$, L2$x$.

Incidentally, as the main causes of the positional deviation occurring individually in the apparatus main body, there is unevenness of rotating speeds of the rotary members such as the photosensitive member 1, the conveyance belt 7, the polygon mirror of the exposure device 53 and the like. Also, a deviation of the light emitting timing of the exposure device 53 is one cause. These are caused due to inherent mechanical unevenness of the apparatus such as the eccentricity of the rotary members, the disorder of pitches of gears configured to drive the rotary members, the deviations of mounting positions of the rotary members, and the like. For example, when the conveying speed of the conveyance belt 7 is faster than a target speed, which is an example of a specific positional deviation, an image is stretched in the sub-scanning direction. Also, when a rotating speed of the polygon mirror is faster than a target speed, an image is stretched in the main scanning direction and contracted in the sub-scanning direction. Also, when the exposing time is longer than a target time, an image is stretched in the main scanning direction. For this reason, the printer 100 is required to adjust the rotating speeds of the respective rotary members and the light emitting timing of the exposure device 53 so as to form an image that a user wants.

The printer 100 is configured to calculate a positional deviation ratio by using the remaining marks 28Uz, 28Lz. Specifically, the printer 100 is configured to obtain the reference start positions at which the formation of the marks 28 starts and the reference end positions at which the formation is over, on the basis of the detection results of the mark sensor 25, thereby obtaining remaining mark lengths M1$x$, M2$x$, which are distances between the reference start positions and the reference end positions (refer to FIGS. 4-1B and 4-2B). The printer 100 is configured to calculate a positional deviation ratio in the sub-scanning direction, which is the conveying direction of the sheet, by comparing the remaining mark lengths based on the detection results of the mark sensor 25 and remaining mark lengths assumed on the design.

Subsequently, a sequence of printing processing including the printing magnification adjustment, which is the control of the printer 100, is described with reference to a flowchart of FIG. 5. When a printing instruction is received, the printing processing is executed by the CPU 31. Incidentally, a printing job from an external device through the communication interface 37 is received or a printing command is input through the operation device 40, so that the printing instruction is received.

In the printing processing, the printer 100 first determines whether an update condition of the printing magnification is satisfied (S151). As the update condition of the printing magnification, detection of at least one of a change in the number of sheets except for printing, an increase in the sheet feeding tray, a replacement of the sheet and an opening or closing operation of the sheet feeding tray may be exemplified. The change in the number of sheets except for printing includes an increase in the number of sheets resulting from replenishment of sheets or a decrease in the number of sheets resulting from obtaining the sheets. When at least one of the above situations is detected, there is a high possibility that a type of the sheet will be changed. In addition, for example, the update condition of the printing magnification may include a situation where an adjustment value of the printing magnification is not stored in the printer 100, a situation where a change amount in temperature or humidity from a previous update is equal to or greater than a threshold, a situation where the number of printed sheets from the previous update is equal to or greater than a defined number and a situation where a user inputs an update instruction.

When the sheet is replenished or the sheet feeding tray is increased, there is a high possibility that the type of the sheet will be changed. A moisture absorption amount of the sheet is different depending on the type of the sheet, so that the sheet shrinkage ratio is also changed. For this reason, the printing magnification is again adjusted at timing at which the sheet is replenished or the sheet feeding tray is increased. Specifically, the printer 100 is configured to store an update flag in the NVRAM 34. When the replenishment of the sheet or the increase in the sheet feeding tray is detected, the printer 100 sets the update flag from OFF to ON. In S151, the printer 100 reads out the update flag to determine whether the sheet is replenished or whether the sheet feeding tray is increased. After updating the printing magnification, the printer 100 sets the update flag from ON to OFF.

When the update condition of the printing magnification is satisfied (S151: YES), the printer 100 determines whether a printing target is internal data (S152). The internal data includes mark data for manual adjustment, test print data, print hysteresis data, and apparatus status data, for example. A printed material of the internal data is not preserved for a long time or provided to a third party, and is discarded early after it is checked and a degree of importance thereof is relatively low. On one hand, when obtaining an adjustment value of the printing magnification, the printer 100 uses one sheet. Therefore, when the printing target is the internal data (S152: YES), the printer 100 executes magnification measuring processing of updating the adjustment value of the printing magnification (S153). On the other hand, when the update condition of the printing magnification is not satisfied (S151: NO) or when the printing target is not the internal data (S152: NO), the printer 100 does not update the adjustment value of the printing magnification.

Figure 6:
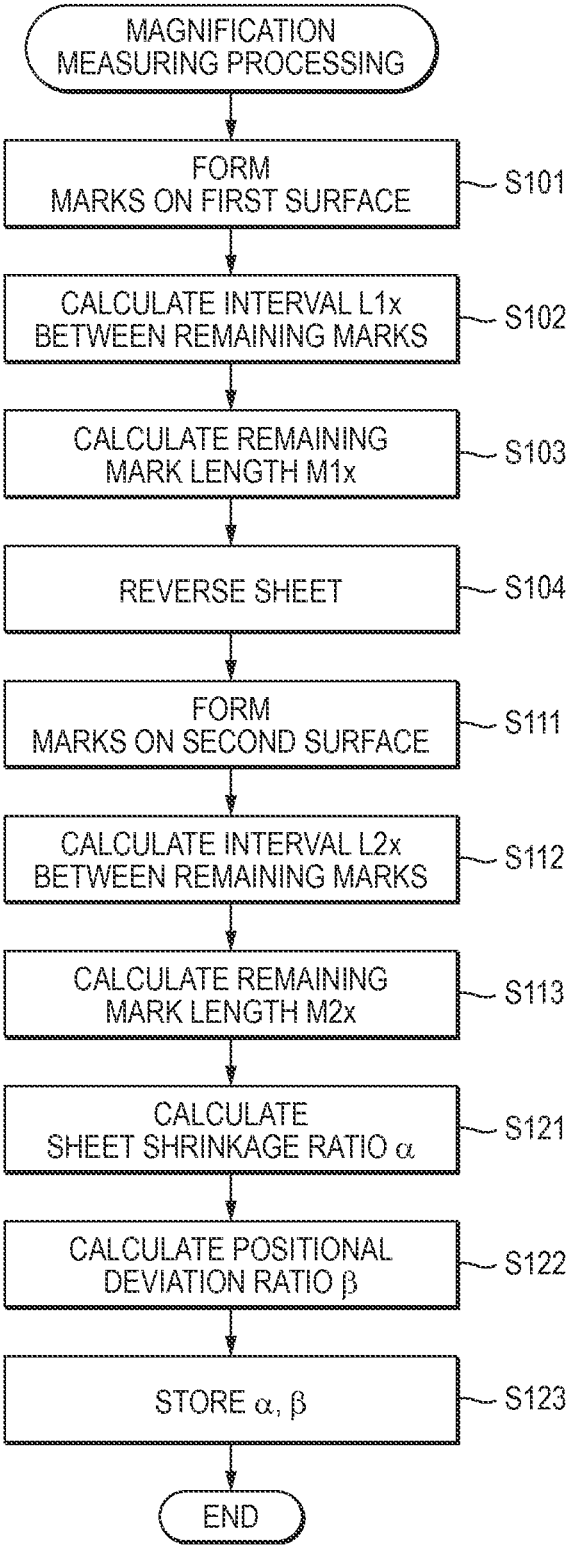
FIG. 6 is a flowchart showing a sequence of magnification measuring processing of a first aspect, which is executed by the printer.

FIG. 6 shows a sequence of the magnification measuring processing of S153. In the magnification measuring processing, the printer 100 first starts to convey one sheet and forms the marks 28 (refer to FIG. 4-1A) on the first surface of the sheet by the process device 50K (S101).

After that, the printer 100 conveys the sheet having the marks 28 formed thereon to the fixing device 8, and detects the remaining marks 28Uz, 28Lz (refer to FIG. 4-1B) left on the conveyance belt 7 on the basis of the output signals of the mark sensor 25, thereby calculating the interval L1*x* of the remaining marks 28Uz, 28Lz (S102). Also, the printer 100 calculates the remaining mark length M1*x* (S103).

Specifically, in S102, the printer 100 calculates an average value of the interval L1xR of the remaining marks 28Uz, 28Lz obtained on the basis of the output signal of the mark sensor 25R and the interval L1xL of the remaining marks 28Uz, 28Lz obtained on the basis of the output signal of the mark sensor 25L. Then, the printer 100 sets a result of the calculation as the interval L1*x*. Also, in S103, the printer 100 calculates an average value of the remaining mark length M1xR obtained on the basis of the output signal of the mark sensor 25R and the remaining mark length M1xL obtained on the basis of the output signal of the mark sensor 25L. Then, the printer 100 sets a result of the calculation as the remaining mark length M1*x*.

Also, the printer 100 conveys the sheet having the marks 28 formed thereon to the fixing device 8, and reverses the conveying direction of the sheet by the sheet discharge rollers 26 to re-convey the sheet to the conveyance belt 7 via the re-conveyance path 12 (S104). Then, the printer 100 forms the marks 28 (refer to FIG. 4-2A) on the second surface of the sheet by the process device 50K, like the first surface (S111). The step S111 is an example of the formation processing.

Thereafter, the printer 100 conveys the sheet having the marks 28 formed thereon to the fixing device 8, and detects the remaining marks 28Uz, 28Lz (refer to FIG. 4-2B) left on the conveyance belt 7 on the basis of the output signals of the mark sensor 25, thereby calculating the interval L2*x* of the remaining marks 28Uz, 28Lz (S112). Also, the printer 100 calculates the remaining mark length M2*x* (S113).

Subsequently, the printer 100 calculates a sheet shrinkage ratio α, based on the results of S102 and S112 (S121). Specifically, in S121, the printer 100 calculates the sheet shrinkage ratio α, based on a following equation (1).

$$\alpha = L2x/L1x \tag{1}$$

Also, the printer 100 calculates a positional deviation ratio β, based on the results of S103 and S113 (S122). Specifically, in 122, the printer 100 calculates the positional deviation ratio β, based on a following equation (2). Incidentally, the steps S121 and S122 may be reversed.

$$\beta = ((M2x + M1x)/2)/Mx \tag{2}$$

In the equation (2), Mx indicates a design remaining mark length.

Incidentally, the positional deviation occurring individually in the apparatus main body is caused due to the mechanical unevenness and occurs in the same manner whenever the printing is performed. That is, in the magnification measuring processing, the positional deviation occurs upon the printing on the second surface as well as upon the printing on the first surface. For this reason, the measurement of the remaining mark length may be performed in any one of S103 and S113, and the measured value and the design remaining mark length Mx may be compared in S122. In the printer 100 of the illustrative embodiment, in order to obtain the positional deviation ratio β with higher precision, the remaining mark lengths are measured on both the first surface and the second surface, and an average value thereof is used to calculate the positional deviation ratio β.

Also, the sheet shrinkage ratio α calculated in S121 is a sheet shrinkage ratio in the sub-scanning direction. For this reason, a sheet shrinkage ratio in the main scanning direction is also calculated on the basis of the sheet shrinkage ratio α in the sub-scanning direction. That is, it is possible to suppose a sheet size from the interval L1*x* of the remaining marks on the first surface. Therefore, the sheet shrinkage ratio in the main scanning direction is supposed from a comparison of horizontal and vertical sizes of the sheet. The positional deviation ratio β is also the same.

After S121 and S122, the printer 100 stores the calculated sheet shrinkage ratio α and positional deviation ratio β in the NVRAM 34 (S123). When the sheet shrinkage ratio α and the positional deviation ratio β have been already stored, the calculated sheet shrinkage ratio α and positional deviation ratio β are overwritten. That is, the printer 100 updates the sheet shrinkage ratio α and the positional deviation ratio β. After S123, the printer 100 ends the magnification measuring processing.

Figure 5:
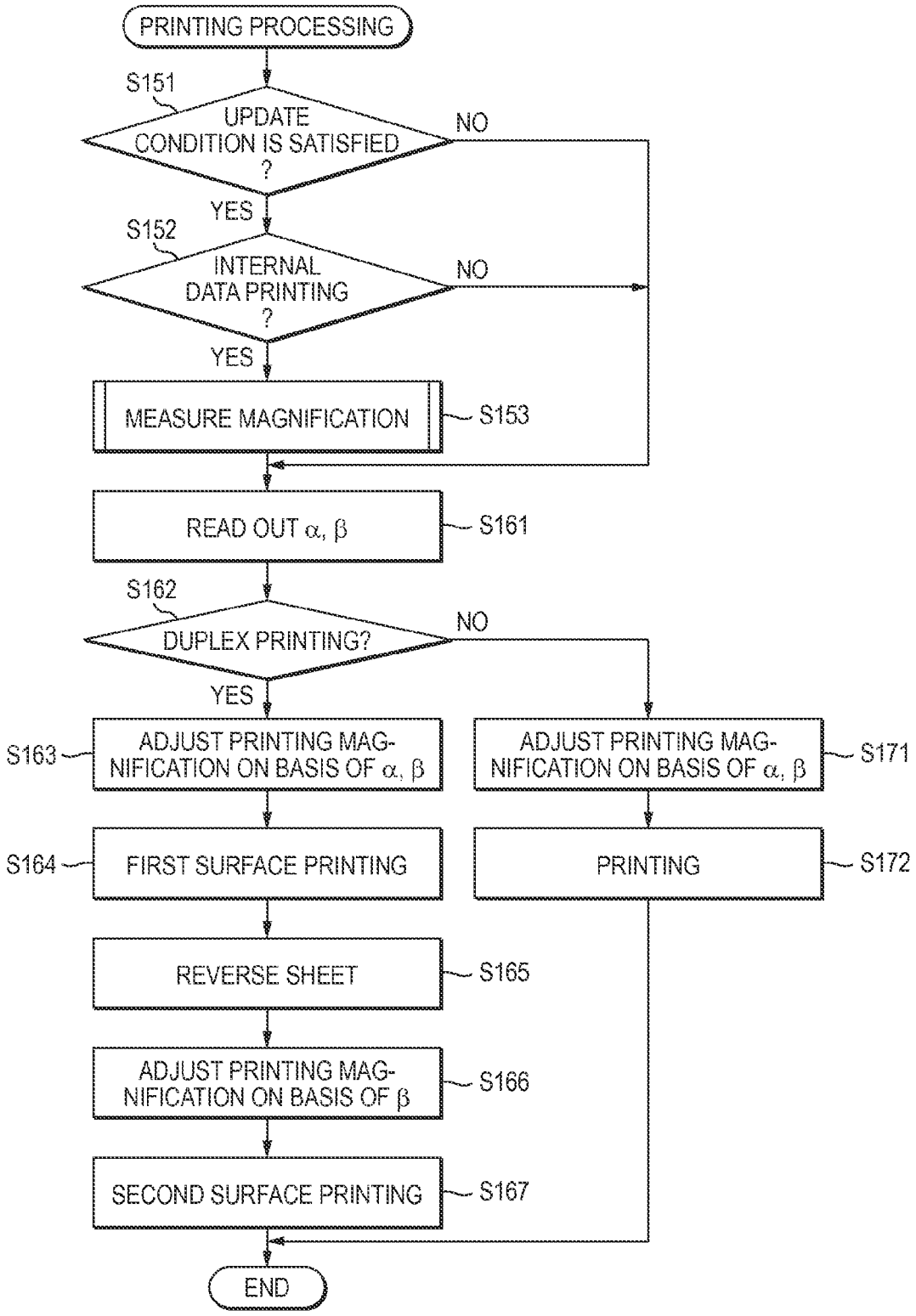
FIG. 5 is a flowchart showing a sequence of printing processing that is executed by the printer.

Back to the descriptions of FIG. 5, after the magnification measuring processing or when the update condition of the printing magnification is not satisfied (S151: NO) or when the printing target is not the internal data (S152: NO), the printer 100 reads out the sheet shrinkage ratio α and positional deviation ratio β stored in the NVRAM 34 (S161). Then, the printer 100 determines whether to perform the duplex printing (S162).

In case of performing the duplex printing (S162: YES), the printer 100 adjusts the printing magnification by using the sheet shrinkage ratio α and positional deviation ratio β when performing the printing on the first surface (S163). The step S163 is an example of the adjustment processing. After S163, the printer 100 performs the printing on the first surface, based on the adjustment (S164).

Specifically, the printer 100 performs at least one of adjustment of a light emitting start timing and a length of light emitting time of the exposure device 53, adjustment of the rotating speed of the polygon mirror of the exposure device 53 and adjustment of the rotating speeds of the photosensitive member 1 and the conveyance belt 7. For example, it is possible to enlarge an output image in the main scanning direction by making the light emitting start timing of the exposure device 53 faster or prolonging the light emitting time. Alternatively, it is possible to expand an output image in the main scanning direction and to contract the same in the sub-scanning direction by making the rotating speed of the polygon mirror faster, and to expand an output image in the sub-scanning direction and to contract the same in the main scanning direction by slowing the rotating speed of the polygon mirror. Alternatively, it is possible to expand an output image in the sub-scanning direction by making the rotating speeds of the photosensitive member 1 and the conveyance belt 7 faster.

After S164, the printer 100 reverses and conveys the sheet (S165) and adjusts the printing magnification by using the positional deviation ratio β (S166). As described above, when the sheet passes through the fixing device 8, the moisture of the sheet is taken away, which is the main cause of the sheet shrinkage. For this reason, in the case of the duplex printing, the moisture is taken away from the sheet upon the printing of the first surface, so that the sheet is shrunken. On the other hand, upon the printing of the second surface, since the moisture absorption amount of the sheet has been already reduced, the shrinkage amount of the sheet is smaller, as compare to the printing of the first surface. For this reason, the printer 100 of this illustrative embodiment does not consider the sheet shrinkage ratio α upon the printing of the second surface. The step S166 is an example of the adjustment processing. After S166, the printer 100 performs the printing on the second surface, based on the adjustment (S167).

On the other hand, when performing the one-side printing (S162: NO), the printer 100 adjusts the printing magnification by using the sheet shrinkage ratio α and the positional deviation ratio β, like the first surface of the duplex printing (S171). The step S171 is an example of the adjustment processing. Then, the printer 100 performs the printing, based on the adjustment (S172). After S172 or S167, the printer 100 ends the printing processing.

Figure 7:
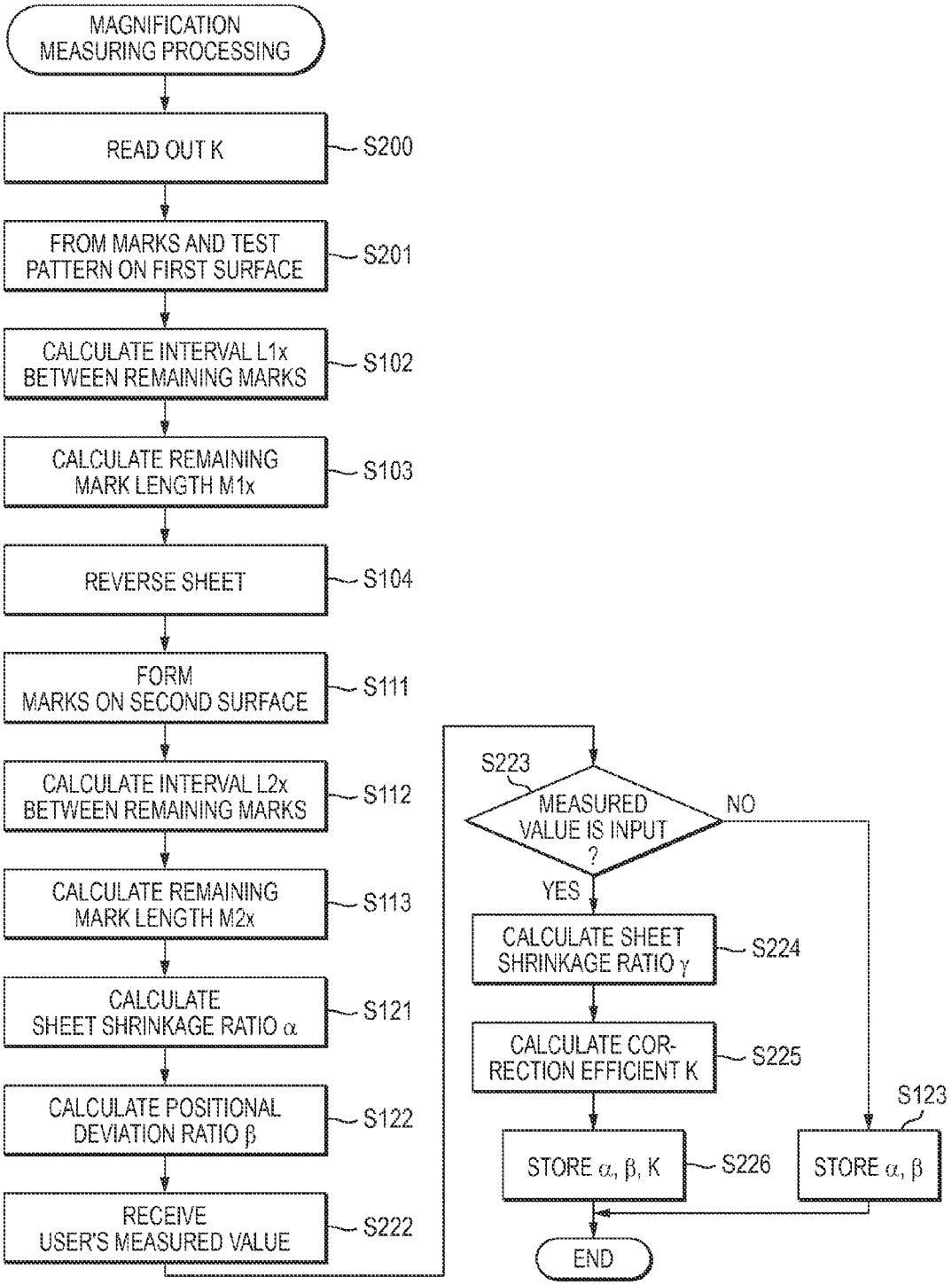
FIG. 7 is a flowchart showing a sequence of magnification measuring processing of a second aspect, which is executed by the printer.

Subsequently, a second aspect of the magnification measuring processing is described with reference to a flowchart of FIG. 7. In the second aspect, the printer 100 is configured to obtain a sheet shrinkage ratio γ based on a user's determination with eyes and to calculate a final sheet shrinkage ratio α, taking into consideration the sheet shrinkage ratio γ, too. This is different from the first aspect where the user's determination with eyes is not used. Incidentally, the same processing of the second aspect as the first aspect is denoted with the same reference numerals and the descriptions thereof are omitted.

In the magnification measuring processing of the second aspect, the printer 100 first reads out a correction coefficient K for correcting a difference between the sheet shrinkage ratio α based on the output signals of the mark sensor 25 and the sheet shrinkage ratio γ based on a user's input (S200). The correction coefficient K will be described in detail later.

Figure 8:
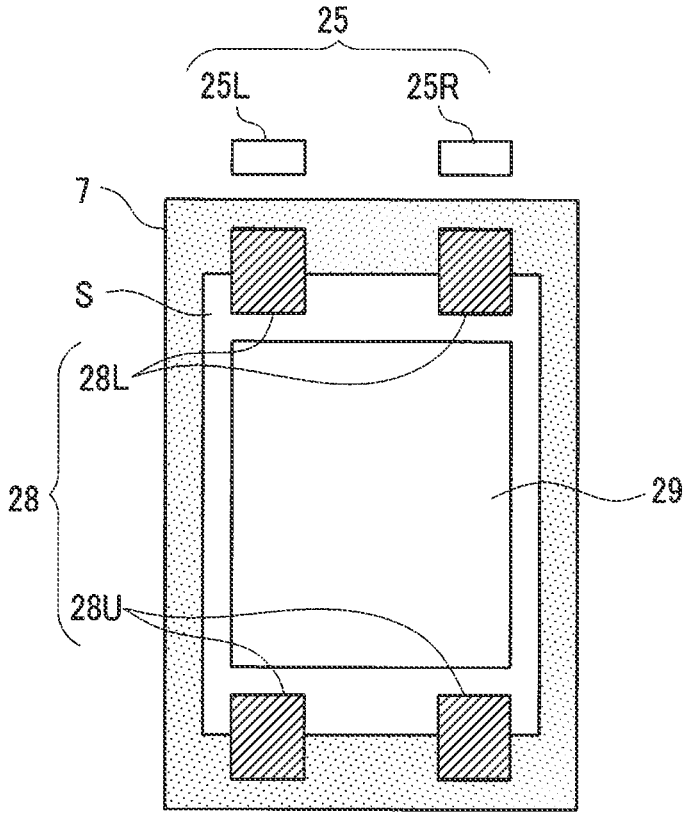
FIG. 8 illustrates an outline of marks and a test pattern formed on a first surface.

Then, the printer 100 forms the marks 28 and a test pattern 29 for enabling a user to see and determine a shrinkage ratio on the first surface of the sheet by the process device 50K (S201), as shown in FIG. 8. As the test pattern 29, a square frame having a specific size is formed, for example. The test pattern 29 is an example of the mark for manual adjustment. In S201, the printer 100 forms the marks 28 and the test pattern 29, based on the printing magnification corrected on the basis of the correction coefficient K read out in S200. Incidentally, when the correction coefficient K is not stored, i.e., when it is not possible to read out the correction coefficient K in S200, the printer 100 does not correct the printing magnification.

After S201, the printer 100 calculates the interval L1*x* of the remaining marks 28Uz, 28Lz (S102) and the remaining mark length M1*x* (S103). Then, the printer 100 reverses and conveys the sheet (S104) and forms the marks 28 on the second surface of the sheet by the process device 50K (S111). Also in S111, the printer 100 forms the marks 28 and the test pattern 29, based on the printing magnification corrected on the basis of the correction coefficient K read out in S200.

After that, the printer 100 again calculates the interval L2*x* of the remaining marks 28Uz, 28Lz (S112) and the remaining mark length M2*x* (S113). The sheet is discharged onto the sheet discharge tray 92. Then, the printer 100 calculates the sheet shrinkage ratio α, based on the results of S102 and S112 (S121). Also, the printer 100 calculates the positional deviation ratio β, based on the results of S103 and S113 (S122).

Also, after discharging the sheet having the test pattern 29 formed thereon, the printer 100 receives an input of a measured value, which is measured by the user's eyes (S222). The user measures a length of one side of the printed test pattern 29 with a ruler and inputs the measured value, for example. Then, the printer 100 determines whether the measured value is input through the operation device 40 within predetermined time (S223). When the measured value is not input (S223: NO), the printer 100 stores the sheet shrinkage ratio α and positional deviation ratio β (S123) and ends the magnification measuring processing. On the other hand, when the user inputs the information indicating that the user will not input the measured value, it is considered that there is no input of the measured value.

On the other hand, when the measured value is input (S223: YES), the printer 100 calculates the sheet shrinkage ratio γ by using the input measured value (S224). For example, when a square frame having a specific size is printed as the test pattern 29, a value 'an input value of a user/the specific size' is the sheet shrinkage ratio γ. After that, the printer 100 calculates the correction coefficient K (S225). Specifically, in S225, the printer 100 calculates the correction coefficient K, based on a following equation (3).

$$K=\gamma/\alpha \tag{3}$$

After S225, the printer 100 stores the sheet shrinkage ratio α, the positional deviation ratio β and the sheet shrinkage ratio γ (S226) and ends the magnification measuring processing. In the image formation thereafter, when using the sheet shrinkage ratio α, the printer 100 corrects the printing magnification by using the correction coefficient K. Specifically, the printer 100 uses the correction coefficient K in S202 and S111 of the magnification measuring processing and in S163 and S171 of the printing processing.

That is, in the magnification measuring processing of the second aspect, when the sheet shrinkage ratio γ is obtained on the basis of the user's determination with the eyes, the sheet shrinkage ratio γ is reflected on the printing magnification upon the image formation. Thereby, it is possible to expect the improvement on the adjustment precision.

Figure 9:
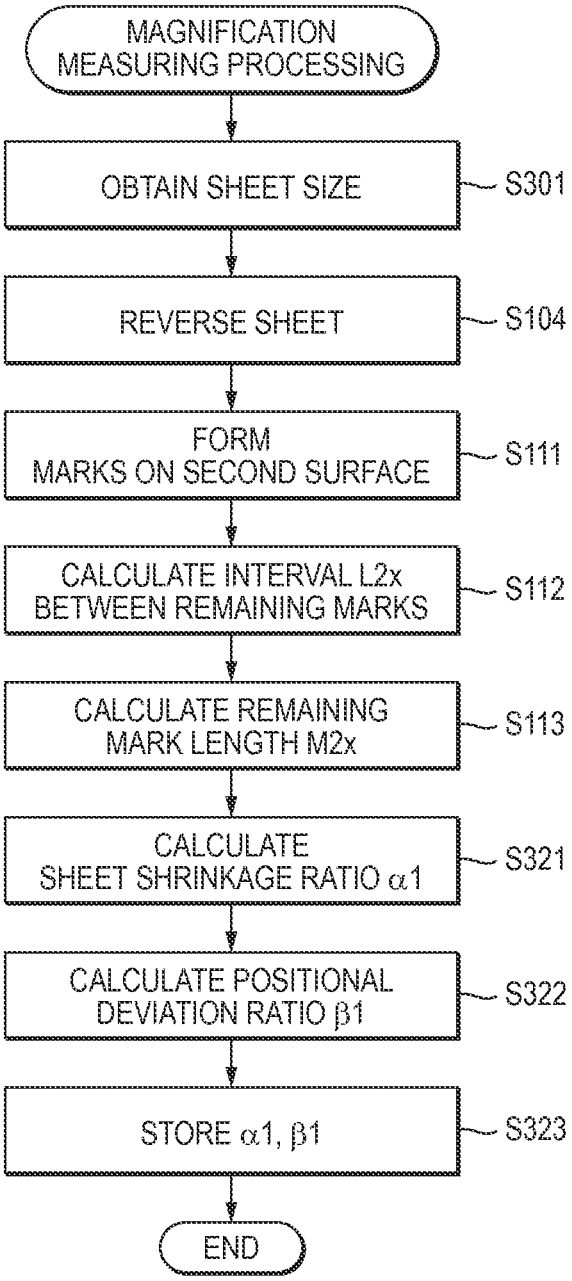
FIG. 9 is a flowchart showing a sequence of magnification measuring processing of a third aspect, which is executed by the printer.

Subsequently, a third aspect of the magnification measuring processing is described with reference to a flowchart of FIG. 9. In the third aspect, the printer 100 is configured to obtain a sheet size, to form the marks only on the second surface, and to calculate a sheet shrinkage ratio α1 on the basis of the obtained sheet size. This is different from the first aspect where the marks are formed on the first and second surfaces. Incidentally, the same processing of the third aspect as the first aspect is denoted with the same reference numerals and the descriptions thereof are omitted.

In the magnification measuring processing of the third aspect, the printer 100 first obtains a sheet size (S301). Regarding the sheet size, the printer 100 requests the user to input a sheet size, for example. Also, when a sheet size is set for the sheet feeding tray 91, the printer 100 may obtain the corresponding sheet size. Also, when a sensor configured to detect whether there is a sheet is arranged at an upstream side of the registration rollers 22, the printer 100 may calculate and obtain a sheet size on the basis of a time length for which the sensor detects whether there is a sheet. The step S301 is an example of the obtaining processing.

After that, the printer 100 controls the sheet to pass through the fixing device 8 without performing a printing on the sheet, reverses and conveys the sheet (S104) and forms the marks 28 on the second surface of the sheet by the process device 50K (S111). Then, the printer 100 calculates the interval L2*x* of the remaining marks 28Uz, 28Lz (S112) and the remaining mark length M2*x* (S113).

After that, the printer 100 calculates a sheet shrinkage ratio $\alpha 1$ on the basis of the result of S112 (S321). Specifically, in S321, the printer 100 calculates the sheet shrinkage ratio $\alpha 1$ on the basis of a following equation (4).

$$\alpha 1 = L2x/L0x \quad (4)$$

Here, L0*x* indicates an assumed interval of the remaining marks 28Uz, 28Lz when the marks 28 are formed on the sheet of the sheet size obtained in S301.

Also, the printer 100 calculates a positional deviation ratio $\beta 1$ on the basis of the result of S113 (S322). Specifically, in S322, the printer 100 calculates the positional deviation ratio $\beta$ on the basis of a following equation (5).

$$\beta 1 = M2x/Mx \quad (5)$$

In the equation (5), Mx indicates a design remaining mark length.

After S322, the printer 100 stores the sheet shrinkage ratio al and the positional deviation ratio $\beta 1$ (S323) and ends the magnification measuring processing. In the printing processing thereafter, the printer 100 adjusts the printing magnification by using the sheet shrinkage ratio $\alpha 1$ and the positional deviation ratio $\beta 1$. In the magnification measuring processing of the third aspect, since it is possible to adjust the sheet shrinkage ratio by forming the marks one time, it is possible to reduce the consumption of the toner. On the other hand, when the sheet shrinkage ratio is adjusted by forming the marks two times, like the first aspect, there is no user's labor to input the sheet size and it is possible to suppress an influence, which is caused when the user incorrectly inputs the sheet size. Also, in the third aspect, when the printer 100 measures the sheet size, the methods of obtaining the sheet size at the first time and the second time are different, so that the printer is likely to be influenced by the unevenness of the precision of the obtaining method. However, in the first aspect, since the methods of obtaining the sheet size at the first time and the second time are the same, the influence is suppressed. As a result, it is possible to expect that the printing magnification will be adjusted more precisely.

As described above, according to the printer 100 of this illustrative embodiment, when adjusting the printing magnification, the marks 28 bridging over the sheet and the conveyance belt 7 are formed on the sheet having passed through the fixing device 8 and the remaining marks 28Uz, 28Lz left on the conveyance belt 7 are read by the mark sensor 25. For this reason, the mark sensor 25 may be arranged at any position at which the mark sensor 25 can read the marks on the conveyance belt 7, and is not limited to a position at which the mark sensor 25 can read the marks on the sheet being conveyed by the conveyance belt 7. Also, since it is not necessary to read the parts of the marks to be left on the sheet, the marks 28 may be formed on any surface of the sheet. For this reason, a sheet conveying mechanism for enabling the same surface to be printed upon the first printing and upon the second time printing is not required. Therefore, the printer 100 has less limitation as regards the apparatus configuration and a high degree of freedom of the apparatus design is high.

The above-described illustrative embodiment is just exemplary and is not intended to limit the present disclosure. Therefore, the present disclosure can be variously improved and modified without departing from a gist thereof. For example, the image forming apparatus is not limited to the printer, and may be any apparatus having a printing function, such as a copier, a FAX apparatus, a complex machine and the like. Also, the printer 100 of the illustrative embodiment is a color printer and has the process devices 50C, 50M, 50Y, 50K corresponding to the respective colors. However, the printer 100 may also be a monochrome printer having one process device.

Also, in the above-described illustrative embodiment, the marks 28 corresponding to the respective mark sensors 25R, 25L are formed. However, the marks may be formed at any one side, in correspondence to only one of the mark sensors 25R, 25L. Thereby, it is possible to reduce the consumption of the toner. Incidentally, when the marks are formed at both sides, like the above-described illustrative embodiment, it is possible to expect that the printing magnification will be adjusted more precisely.

Also, in the above-described illustrative embodiment, the central positions of the respective remaining marks 28Uz, 28Lz in the conveying direction of the sheet are detected and the interval between the remaining marks 28Uz, 28Lz is regarded as the sheet length. However, a downstream end of the remaining mark 28Uz and an upstream end of the remaining mark 28Lz may be detected and an interval therebetween may be regarded as the sheet length.

Also, in the above-described illustrative embodiment, the sheet shrinkage ratio in the main scanning direction is supposed from the sheet shrinkage ratio in the sub-scanning direction. However, the present disclosure is not limited thereto. For example, when the printer 100 has a line sensor capable of detecting a position of a mark in the main scanning direction, both ends of the sheet in the main scanning direction may be formed respectively with marks bridging over the sheet and the conveyance belt 7, like the sub-scanning direction, and the remaining marks left on the conveyance belt 7 may be detected to obtain a sheet shrinkage ratio in the main scanning direction. In this case, it is also possible to obtain the positional deviation ratio in the main scanning direction in the same manner.

Also, in the above-described illustrative embodiment, the marks 28 are formed by the process device 50K. However, the marks may also be formed by a separate process device. For example, the process device having the largest remaining amount of the toner upon the formation of the marks may be configured to form the marks. However, when the marks 28 are formed by the same process device, like the above-described illustrative embodiment, it is possible to avoid the influence of the deviation between the process devices on the printing magnification. In particular, in the case of the black (K) mark, the diffusion reflection light thereof is less and the detection precision of whether or not the mark is higher than the other colors. Therefore, it is preferably to form the marks 28 by the process device 50K.

Also, in the above-described illustrative embodiment, both the conditions, i.e., when the update condition of the printing magnification is satisfied (S151) and when the printing target is the internal data (S152), the magnification measuring processing is executed. However, when any one condition is satisfied, the magnification measuring processing may be executed. Alternatively, only one of the two conditions may be determined. Also, the magnification measuring processing may be executed on the basis of the other conditions.

Also, in the above-described illustrative embodiment, the positional deviation ratio β is obtained in the magnification measuring processing. However, the positional deviation ratio may be obtained using marks different from the marks 28. That is, the positional deviation ratio β may be obtained at timing different from the magnification measuring processing.

Also, in the above-described illustrative embodiment, when performing the one-side printing, the sheet shrinkage ratio α is used to adjust the printing magnification (S171). However, the printing magnification may not be adjusted. That is, upon the duplex printing, the unevenness of the outward appearance occurs between the first surface and the second surface due to the shrinkage of the sheet. However, upon the one-side printing, the unevenness of the outward appearance does not occur. For this reason, the adjustment of the printing magnification using the sheet shrinkage ratio α may be omitted.

Also, when forming the marks on the first surface in S101, a dummy image may be printed on the sheet. That is, the sheet shrinkage ratio may be changed due to the toner amount printed on the sheet. For this reason, when a dummy image, which consumes a toner amount equivalent to an average using amount of the toner upon one printing, is printed, it is possible to expect that a sheet shrinkage ratio closer to the sheet shrinkage ratio upon the user's using will be obtained.

Also, in the above-described illustrative embodiment, in the magnification measuring processing, the marks 28 are formed on the sheet automatically re-conveyed and having passed through the main body device 8. However, the present disclosure is not limited thereto. For example, the printer 100 may be configured to discharge the sheet having passed through the main body device 8 onto the sheet discharge tray 92 without reverse conveying the same, and to notify the user that the user should set the corresponding sheet on the sheet feeding tray 91 and press a start button after the setting. When the user presses the start button, the printer 100 may again convey the sheet to the process device 50, thereby calculating the sheet shrinkage ratio α and the positional deviation ratio β.

Also, the processing of the above-described illustrative embodiment may be executed by the hardware such as a single CPU, a plurality of CPUs, an ASIC and the like or a combination thereof. Also, the processing of the above-described illustrative embodiment may be implemented in diverse aspects such as a recording medium having a program for executing the processing recorded therein, a method thereof and the like.

What is claimed is:

1. An image forming apparatus comprising:

an image forming device configured to form an image;

a fixing device configured to heat-fix the image on a sheet;

a belt configured to convey the sheet toward the fixing device;

a sensor; and a control device configured to:

control the image forming device to form marks bridging over the belt and the sheet having passed through the fixing device at a first end of the sheet and at a second end of the sheet that is opposite to the first end; and adjust a printing magnification of an image to be formed on the sheet, comprising:

obtaining a length between remaining marks left on the belt after the sheet having the marks formed thereon is conveyed to a downstream side of the belt, on the basis of an output signal of the sensor of which an output is changed depending on whether there are the marks formed on the sheet; and adjusting the printing magnification of the image to be formed on the sheet on the basis of the length between the remaining marks.

2. The image forming apparatus according to claim 1, wherein in the adjusting the printing magnification, the control device is configured to individually adjust the printing magnification on a first surface of the sheet, which is first printed upon a duplex printing, and on a second surface of the sheet, which is later printed.

3. The image forming apparatus according to claim 1, wherein in the adjusting the printing magnification, the control device is configured to:

obtain a deviation value from a reference position of the remaining marks on the basis of the output signal of the sensor; and adjust the printing magnification on the basis of the deviation value and the length between the remaining marks.

4. The image forming apparatus according to claim 1, wherein in the adjusting the printing magnification, the control device is configured to adjust, based on the length between the remaining marks in a first direction, the printing magnification in a second direction.

5. The image forming apparatus according to claim 1, wherein the control device is configured to control the image forming device to form the marks in a case of printing internal data on the sheet.

6. The image forming apparatus according to claim 1, wherein in the adjusting the printing magnification, the control device is configured to change a printing magnification, which is to be obtained on the basis of a next output signal of the sensor, on the basis of a printing magnification obtained when a mark for manual adjustment is printed on the sheet and a printing magnification obtained on the basis of the output signal of the sensor.

7. The image forming apparatus according to claim 1, wherein the control device is configured to control the image forming unit to form the marks in response to detecting at least one of a change in the number of sheets except for a printing, an increase in a sheet feeding tray, a replacement of the sheet and an opening or closing operation of the sheet feeding tray.

8. The image forming apparatus according to claim 1, wherein a plurality of the image forming devices is provided, and wherein in the controlling the image forming device to form the marks, the control device is configured to form the marks by using the same image forming device.

9. The image forming apparatus according to claim 1, wherein in the controlling the image forming device to form the marks, the control device is configured to control the image forming device to form the marks even though the sheet, which is a formation target of the marks, does not pass through the fixing device, and wherein in the adjusting the printing magnification, the control device is configured to adjust the printing magnification of the image, based on a length between remaining marks of the marks formed at a state where the sheet does not pass through the fixing device, and the length between the remaining marks of the marks formed after the sheet passed through the fixing device.

10. The image forming apparatus according to claim 1, wherein the control device is configured to obtain a length of the sheet, and wherein in the adjusting the printing magnification, the control device is configured to adjust the printing magnification of the image based on the length of the sheet obtained in the obtaining the length of the sheet and the length between the remaining marks obtained by the output signal of the sensor.

11. The image forming apparatus according to claim 1, further comprising:

a re-conveyance mechanism configured to convey the sheet having passed through the fixing device toward an upstream side of the belt, wherein the sheet on which the marks are formed in the formation processing is a sheet having passed through the fixing device having been returned to the belt by the re-conveyance mechanism and having been conveyed by the belt.

12. The image forming apparatus according to claim 1, wherein the control device is configured to:

control the image forming device to form first marks bridging over the belt and a first side of the sheet before passing through the fixing device at both ends of the sheet;

after the sheet having the first marks formed thereon is conveyed to a downstream side of the belt, obtain a first interval between remaining first marks left on the belt and a first length between the remaining first marks;

convey the sheet having passed through the fixing device toward an upstream side of the belt by using a re-conveyance mechanism;

control the image forming device to form second marks bridging over the belt and a second side of the sheet having passed through the fixing device at both ends of the sheet;

after the sheet having the first marks formed thereon is conveyed to the downstream side of the belt, obtain a first interval between remaining second marks left on the belt and a second length between the remaining second marks;

obtain a sheet shrinkage ratio on the basis of the first interval and the second interval;

obtain a positional deviation ratio on the basis of the first length and the second length; and adjust the printing magnification on the basis of at least one of the sheet shrinkage ratio and the positional deviation ratio.

13. The image forming apparatus according to claim 12, wherein the control device is further configured to:

in the controlling the image forming device to form the first marks, control the image forming device to form a mark for manual adjustment on the sheet;

receive a measured value on the basis of the mark for manual adjustment;

obtain a sheet shrinkage ratio on the basis of the received measured value;

obtain a correction coefficient on the basis of the sheet shrinkage ratio on the basis of the received measured value and the sheet shrinkage ratio on the basis of the first interval and the second interval; and change a printing magnification, which is to be obtained on the basis of a next output signal of the sensor, with using the correction coefficient.

14. The image forming apparatus according to claim 1, wherein the control device is configured to:

obtain a size of the sheet;

convey the sheet to pass through the fixing device and toward an upstream side of the belt by using a re-conveyance mechanism;

control the image forming device to form the marks bridging over the belt and the sheet having passed through the fixing device at the first end of the sheet and the second end of the sheet;

after the sheet having the marks formed thereon is conveyed to the downstream side of the belt, obtain an interval between remaining marks left on the belt a length between the remaining second marks;

obtain a sheet shrinkage ratio on the basis of the size of the sheet and the interval between the remaining marks;

obtain a positional deviation ratio on the basis of the length between the remaining second marks; and adjust the printing magnification on the basis of at least one of the sheet shrinkage ratio and the positional deviation ratio.

15. An image forming method of an image forming apparatus comprising an image forming device configured to form an image, a fixing device configured to heat-fix the image on a sheet, and a belt configured to convey the sheet toward the fixing device, the image forming method comprising:

controlling the image forming device to form marks bridging over the belt and the sheet having passed through the fixing device at a end of the sheet and at a second end of the sheet that is opposite to the first end; and adjusting a printing magnification of an image to be formed on the sheet, comprising:

obtaining a length between remaining marks left on the belt after the sheet having the marks formed thereon is conveyed to a downstream side of the belt, on the basis of an output signal of a sensor of which an output is changed depending on whether there are the marks formed on the sheet; and adjusting the printing magnification of the image to be formed on the sheet on the basis of the length between the remaining marks.

16. The image forming method according to claim 15, wherein in the adjusting the printing magnification, the method comprises individually adjusting the printing magnification on a first surface of the sheet, which is first printed upon a duplex printing, and on a second surface of the sheet, which is later printed.

17. The image forming method according to claim 15, wherein in the adjusting the printing magnification, the method comprises:

obtaining a deviation value from a reference position of the remaining marks on the basis of the output signal of the sensor; and adjusting the printing magnification on the basis of the deviation value and the length between the remaining marks.

18. A non-transitory computer-readable storage medium having a computer program stored thereon and readable by a computer of an image forming apparatus, the image forming apparatus comprising an image forming device configured to form an image; a fixing device configured to heat-fix the image on a sheet; a belt configured to convey the sheet toward the fixing device and a sensor, the computer program, when executed by the computer, causes the image forming apparatus to perform operations comprising:

controlling the image forming device to form marks bridging over the belt and the sheet having passed through the fixing device at a first end of the sheet and at a second end of the sheet that is opposite to the first end; and adjusting a printing magnification of an image to be formed on the sheet, comprising:

obtaining a length between remaining marks left on the belt after the sheet having the marks formed thereon is conveyed to a downstream side of the belt, on the basis of an output signal of the sensor of which an output is changed depending on whether there are the marks formed on the sheet; and adjusting the printing magnification of the image to be formed on the sheet on the basis of the length between the remaining marks.

19. The non-transitory computer-readable storage medium according to claim 18, wherein in the operation of adjusting the printing magnification, the computer program causes the computer to perform an operation of individually adjusting the printing magnification on a first surface of the sheet, which is first printed upon a duplex printing, and on a second surface of the sheet, which is later printed.

20. The non-transitory computer-readable storage medium according to claim 18, wherein in the operation of adjusting the printing magnification, the computer program causes the computer to perform operations comprising:

obtaining a deviation value from a reference position of the remaining marks on the basis of the output signal of the sensor; and adjusting the printing magnification on the basis of the deviation value and the length between the remaining marks.

* * * * *